United States Patent [19]

Nishimura et al.

[11] Patent Number: 5,018,888

[45] Date of Patent: May 28, 1991

[54] PAPER TENSION ADJUSTING DEVICE AND METHOD FOR A PRINTER

[75] Inventors: Hiroshi Nishimura; Masao Miyasaka; Nobuhiko Itoh; Toshio Hiki; Akira Igarashi, all of Ibaraki, Japan

[73] Assignee: Hitachi Koki Co., Ltd., Ibaraki, Japan

[21] Appl. No.: 405,290

[22] Filed: Sep. 11, 1989

[30] Foreign Application Priority Data

Sep. 20, 1988 [JP] Japan ..... 63-235261

[51] Int. Cl.[5] ..... B41J 11/30; B41J 11/32

[52] U.S. Cl. ..... 400/616.1; 400/616.2; 226/20; 226/74

[58] Field of Search ..... 400/616.1, 616.2, 618, 400/56, 703, 708, 616, 616.3; 226/18–20, 45, 74, 75

[56] References Cited

U.S. PATENT DOCUMENTS

| | | | |
|---|---|---|---|
| 3,373,288 | 3/1968 | Otepka et al. | 226/20 |
| 3,578,138 | 5/1971 | Cantwell | 226/74 |
| 4,652,153 | 3/1987 | Kotsuzumi | 400/56 |
| 4,848,632 | 7/1989 | Mack et al. | 226/20 |
| 4,917,512 | 4/1990 | Mimura et al. | 400/56 |

FOREIGN PATENT DOCUMENTS

| | | | |
|---|---|---|---|
| 151280 | 9/1983 | Japan | 400/618 |
| 22783 | 2/1984 | Japan | 400/616.1 |
| 44470 | 2/1987 | Japan | 400/618 |
| 184871 | 8/1987 | Japan | 400/618 |
| 132072 | 6/1988 | Japan | 400/616.1 |

OTHER PUBLICATIONS

IBM Technical Disclosure Bulletin, "Forms Tension Mechanism"; vol. 29, No. 3, Aug. 1986, pp. 1112–1113.

IBM Technical Disclosure Bulletin, "Optical Sensor Mount for Forms Tractor"; vol. 32, No. 2, Jul. 1989, pp. 1–4.

*Primary Examiner*—Edgar S. Burr
*Assistant Examiner*—Joseph R. Keating
*Attorney, Agent, or Firm*—Michael L. Keller

[57] ABSTRACT

A paper tension adjusting device in which one of the tractors with feeding pins changing feeding apertures in the paper is movable widthwise to adjust widthwise paper tension. The desired tension is determined from paper thickness which is in turn determined from the hammer flight time. Lengthwise tension is adjusted by adjusting paper clampers separated from the tractors. The tension is both widthwise and lengthwise directions is determined by optically sensing the positions of the feeding pin with respect to the aperture in which that pin is engaged.

19 Claims, 5 Drawing Sheets

| | PAPER FEEDING DIRECTION TENSION | | PAPER WIDTHWISE DIRECTION TENSION | |
|---|---|---|---|---|
| | RELATIONSHIP IN POSITION BETWEEN FEEDING PIN AND FEEDING HOLE | CCD SENSOR OUTPUT | RELATIONSHIP IN POSITION OF FEEDING PIN AND FEEDING HOLE | CCD SENSOR OUTPUT |
| a | | | | |
| b | | | | |
| c | | | | |

PAPER TENSION ADJUSTING DEVICE AND METHOD FOR A PRINTER

BACKGROUND OF THE INVENTION

1. Field of the Invention

The present invention relates to a paper tension adjusting device in a printer for performing printing on foldable continuous printing paper, for example, an impact line printer, a laser beam printer, etc.

2. Description of the Prior Art

Typical continuous printing paper has feeding apertures formed at a predetermined pitch along both the longitudinal side edges thereof so that the paper can be fed by tractors which fit into the feeding apertures.

If the respective tensions of the paper in the direction of paper width and in the direction of paper feeding are too large when the paper is mounted on the tractors, the above-mentioned feeding apertures may be broken. When this occurs the paper often jams. On the other hand, if the tensions are too small, the feeding pins of the tractors tend to come out of the feeding apertures of the paper and this also causes paper jams.

Further, even if the widthwise tension is set to a desired value with respect to a single sheet of paper, if the single sheet paper is substituted by a stack of sheets of paper provided with carbon paper inserted therebetween, the tension is no longer correct and there is a possibility of paper jam. Further, if paper tension is not set to a proper value, the quality of printing will be lowered as well.

SUMMARY OF THE INVENTION

It is therefore an object of the present invention to solve the foregoing problems in the prior art.

It is another object of the present invention to provide a paper tension adjusting device in a printer, in which tractors are moved in the direction of the paper width in accordance with the thickness and rigidity of the paper. The paper pressing force of a clamper is changed at the same time so that the tensions of the paper in both the widthwise direction of paper width and in the lengthwise direction of paper feeding can be set to desired values.

The amount of deformation of the feeding apertures depends on the rigidity of the printing paper mounted on tractors. The thicker the paper becomes, the shorter the flight time of the printing hammers to impact onto the paper. Therefore, the present invention includes a detector for detecting the amount of deformation of the feeding apertures and the flight time of the printing hammers so that the respective tensions of the paper in the direction of paper width and in the lengthwise direction of paper feeding required at the time of paper mounting can be automatically and properly adjusted by use of the outputs of the detector.

BRIEF DESCRIPTION OF THE DRAWINGS

Other features and advantages of the present invention will be apparent from the following description taken in connection with the accompanying drawings, wherein.

DETAILED DESCRIPTION OF THE PREFERRED EMBODIMENT

An embodiment of the present invention will be described with reference to the drawings.

Figure 1:
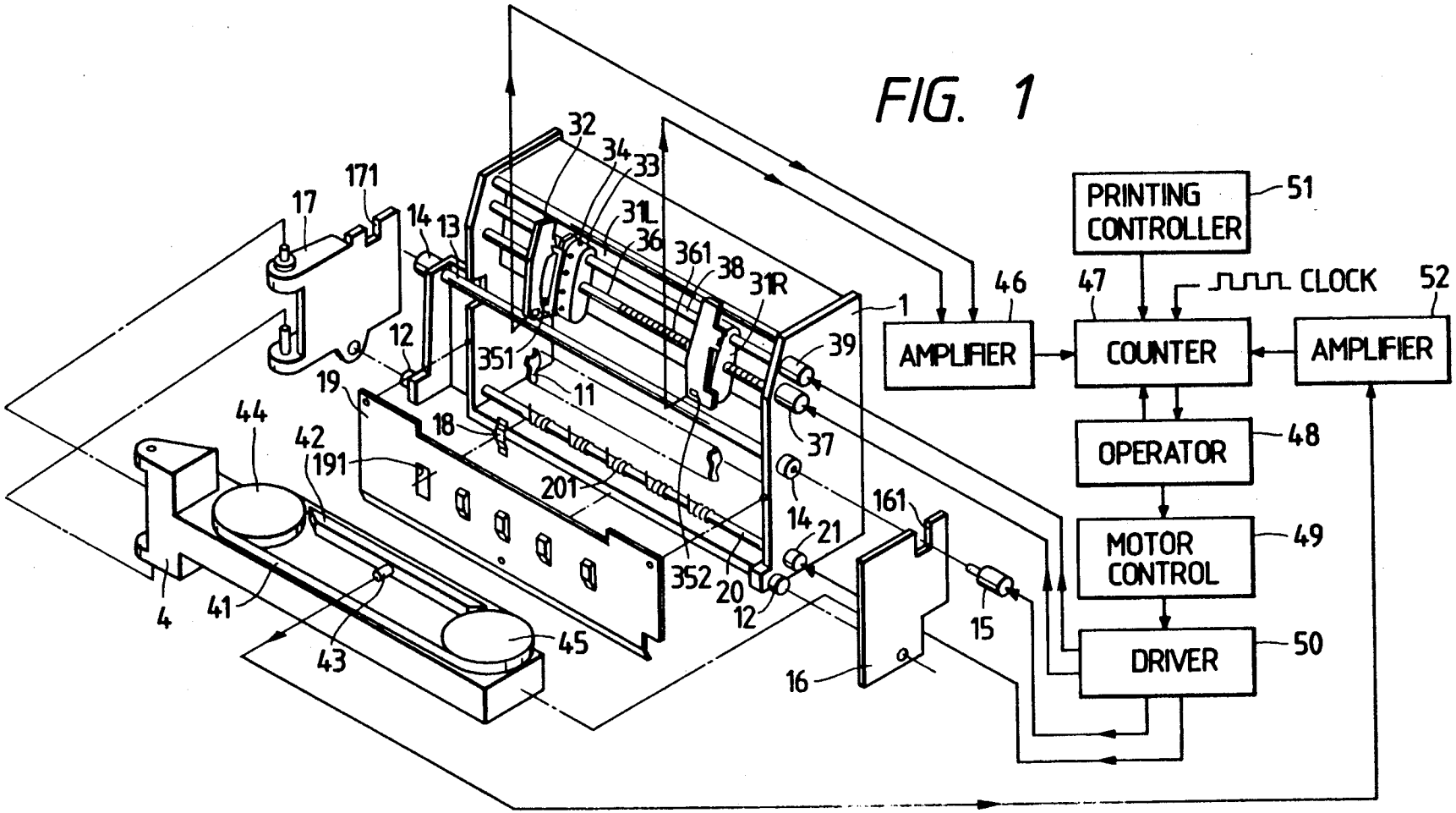
FIG. 1 is a perspective view illustrating an embodiment of the printer according to the present invention.

FIG. 1 is a perspective view illustrating an embodiment of the printer according to the present invention.

Generally, 132 or 136 printing hammers 11 are rotatably provided at regular intervals or pitches of 1/10 inch on a body frame 1 which is a support frame for a printer mechanism. On the opposite sides of the body frame 1, plates 16 and 17 respectively having slots 161 and 171 are attached thereto so as to be rotatable about a pin 12. Further, a rotary shaft 13 for adjusting paper thickness is provided so as to rotatably pass between the slots 161 and 171. Two eccentric cams 14 each having a diameter slightly smaller than the width of each of the slots 161 and 171 are attached to the rotary shaft 13 so that the two eccentric cams 14 are within the slots 161 and 171 respectively while they are coincident in eccentric direction with each other. A motor 15, for example, a step motor, the rotation angle of which can be controlled, is attached to the plate 16, and the top end of the motor 15 is connected to the rotary shaft 13.

A cover plate 19 having a plurality of rectangular holes 191 is attached under the printing hammers 11 so as to cover the front side of the body frame 1, and paper clampers 18 equal in number to the rectangular holes 191 are attached on the cover plate 19 so as to project frontward, that is, toward the left side in FIG. 1. A clamper shaft 20 rotatably supported by the body frame 1 is positioned behind the paper clampers 18 so as to pass through torsion springs 201 which are equal in number to the rectangular holes 191 to thereby hold the torsion springs 201. One end of each of the torsion springs 201 is located just behind the corresponding paper clamper 18 and the other end of the same is fixed to the clamper shaft 20. A motor 21, the rotation angle of which can be controlled, is attached to the body frame 1, and an output shaft of the motor 21 is connected to one end of the clamper shaft 20.

Figures 4, 5:
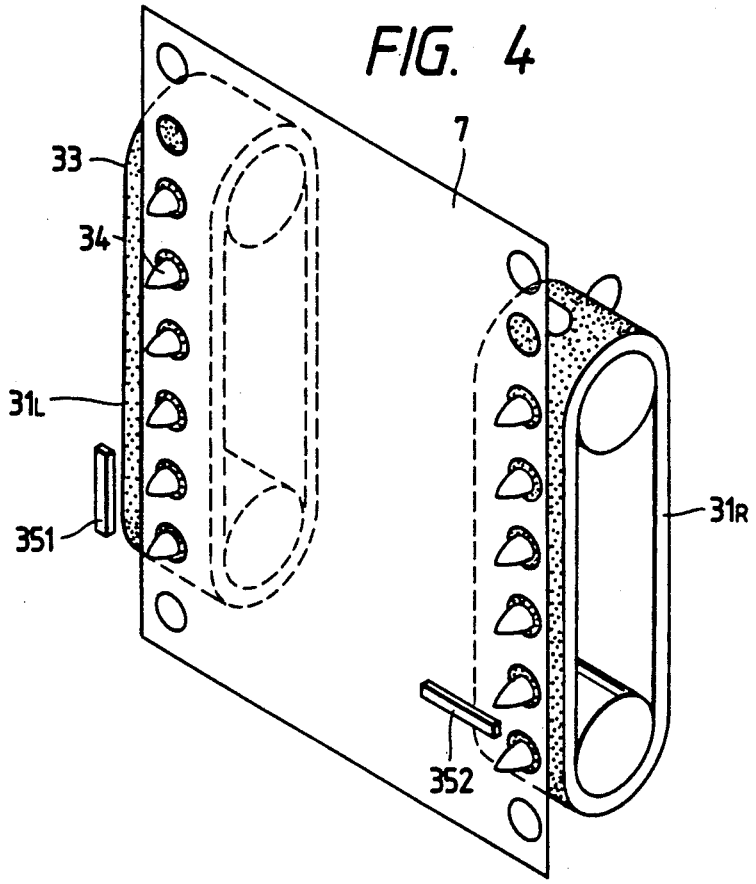
FIG. 4 is a perspective view illustrating the relationship between paper and tractors.
FIG. 5 is an explanatory diagram illustrating a paper tension detecting method.

A paper feeding mechanism, that is, a pair of tractors 31R and 31L are provided at an upper portion of the body frame 1 as shown in detail in FIG. 4. A guide shaft 36 having a helical screw portion 361 formed in the right half thereof, and a driving shaft 38 having a spline or polygonal sectional shape are passed through the tractors 31R and 31L and rotatably supported by the body frame 1. The respective ends of the guide shaft 36 and the driving shaft 38 are connected to the respective output shafts of motors 37 and 39 provided on the body frame 1.

Each of the tractors 31L and 31R have a tractor belt 33 having feeding pins 34 which fit in the feeding apertures of a paper and a cover plate 32 for preventing the paper from coming out of the feeding pins 34. The tractors 31L and 31R are separated lengthwise from clampers 18. A luminous element (not shown) and a line CCD sensor are provided opposite to the feeding pins 34 under the cover plate 32. The feeding pins 34 and the tractor belt 33 are respectively formed of, for example, white and black materials respectively, the light reflection factors of which are large and small respectively. CCD sensor 351 of the left tractor 31L is attached to extend parallel to the paper feeding direction, and CCD sensor 352 of the right tractor 31R is attached to extend perpendicular to the paper feeding direction.

A yoke frame 4 serving as a support frame of a printing belt feeding mechanism is supported by the plate 17 so as to be openable and closable in the front side of the body frame 1. A platen 42 is fixed opposite to the printing hammers 11 through a printing type belt 41. A sensor 43 for converting vibration energy into a voltage, for example, an accelerating pickup, is attached to the platen 42, and output of sensor 43 is applied to an amplifier 52. An amplifier 46, a counter 47, an operator 48, a motor controller 49 and a driver 50 are sequentially connected to the outputs of CCD sensors 351 and 352. The output of the driver 50 is applied to the motors 15, 21, 37 and 39. A printing command signal from controller 51 enables counter 47 when a hammer is provided with a printing command. The counter 47 counts clock pulses until the signal from amplifier 52 indicates detection of impact of the hammer on the paper and disables counter 47.

Figure 2:
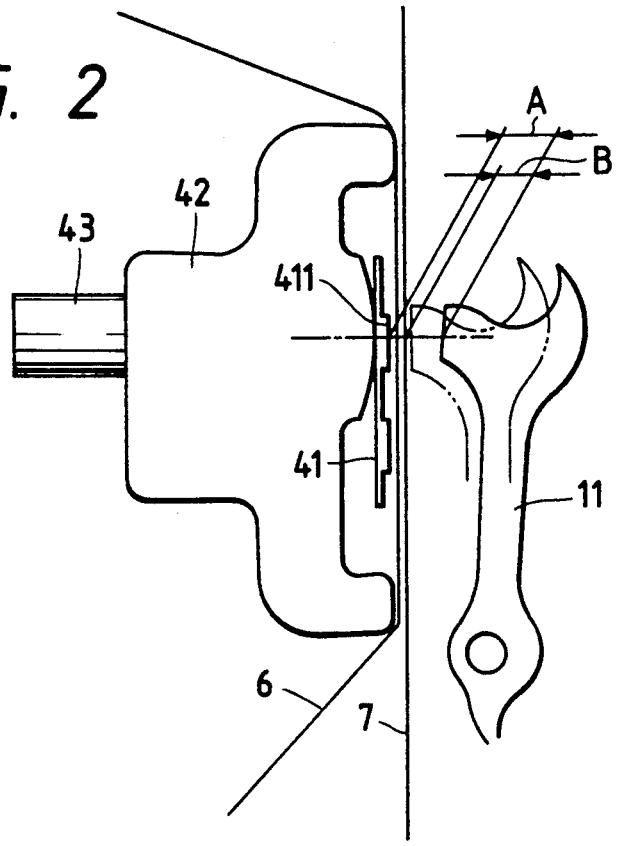
FIG. 2 is a sectional view illustrating a printing mechanism.

FIG. 2 is a sectional view illustrating the printing mechanism, in which an ink ribbon 6 and paper 7 are disposed in front of a printing type 411 provided on the printing type belt 41. According to the printing command of the printing controller 51, the printing hammers 11 are made to fly toward the printing type 411 by a hammer driver (not shown) and electromagnetic actuator (not shown) so as to press the paper 7 and the ink ribbon 6 against the type 411 to thereby print on paper 7.

Figure 3:
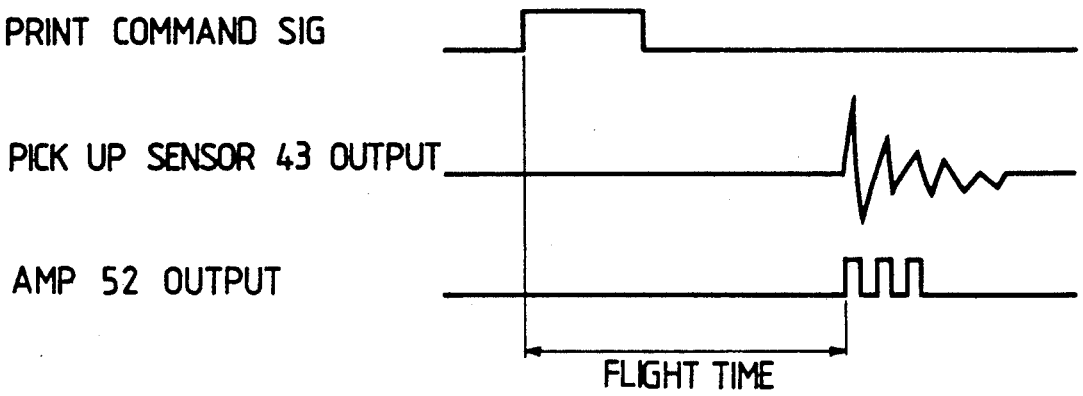
FIG. 3 is a time chart illustrating a flight time detecting method.

FIG. 3 is a time chart illustrating one method for detecting the distance B between the printing hammers 11 and the paper 7. The vibration due to collision between the printing hammers 11 and the printing type 411 is detected by the sensor 43, and the detection output of the sensor 43 is waveform-shaped by the amplifier 52. Since the printing hammers 11 are made to fly substantially at the same speed, the distance B can be detected by measuring the time between generation of a printing command signal and the collision, i.e., the flight time. Clock pulses produced from the time of generation of a printing command signal by the printing controller 51 until the time of generation of a detection signal by the amplifier 52 are counted by the counter 47, so that the flight time of the printing hammers 11 can be detected.

On the basis of the detected flight time, the rotary shaft 13 is rotated by the motor 15, so that the yoke frame 4 is rotated about the pin 12 by the eccentric cams 14 so as to change the distance A between the printing hammers 11 and the printing type 411.

Next, the method of adjusting the tension of the paper 7 will be described.

As the motor 37 rotates the guide shaft 36, the right tractor 31R moves in the widthwise direction of paper 7. It is therefore possible to adjust the widthwise tension of the paper 7 mounted on the pair of tractors 31L and 31R.

If the clamper shaft 20 is rotated by the motor 21, the torsion angles of the torsion springs 201, the respective one ends of which are fixed to the shaft 20, are changed so that the paper pressing force of the paper clampers 18 is changed. It is therefore possible to adjust the tension of the paper 7 in the lengthwise direction of paper feeding.

Next, a method of detecting the tension of paper 7 will be described with reference to FIGS. 4 and 5. FIG. 4 is a diagram illustrating the relationship among the tractor belt 33, the feeding pins 34, the CCD sensors 351 and 352, and the paper 7. FIG. 5 is a diagram illustrating the relationship between the tensional condition of the paper 7 and the output of the CCD sensors 351 and 352. The illustrated output waveforms of the CCD sensors are obtained in the respective cases of scanning that is, (a) shows the case of slight tension, (b) the case of loose tension, and (c) the case of strong tension enough to deform the above-mentioned feeding apertures.

Generally, the paper 7 is white or nearly white paper having a large light reflection and the feeding pins 34 are also white, so that the output of the CCD sensors 351 and 352 takes "1" as a logical value thereof when the paper or pins are detected. On the other hand, the tractor belt 33 is black and therefore has a small light reflection factor, so that the output of the CCD sensors 351 and 352 takes "0" as a logical value thereof when the belt is detected. Therefore, the position of the feeding pins 34 relative to the feeding apertures is detected as shown in FIG. 5, so that the tension of the paper 7 is detected.

Figure 6I:
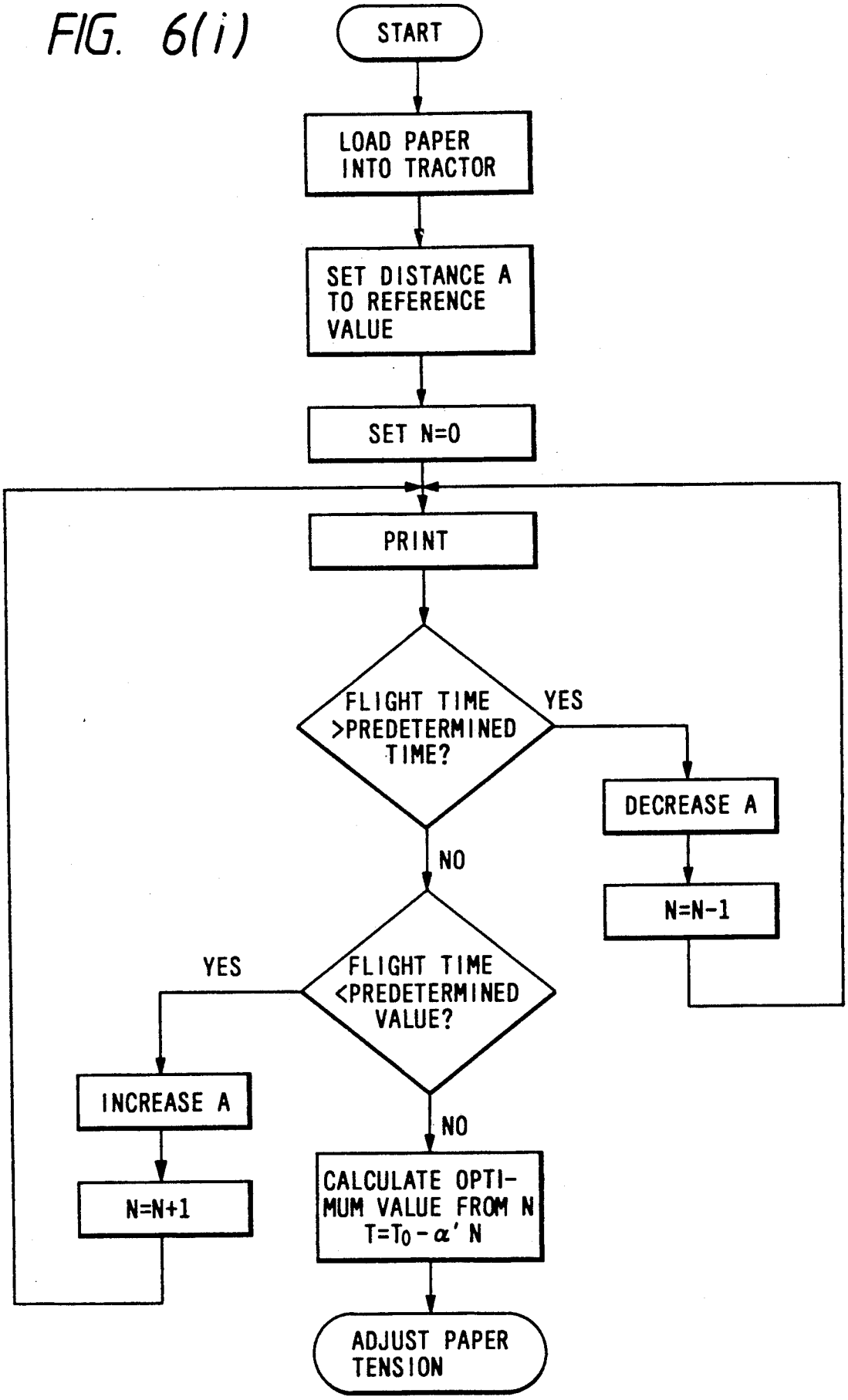
FIG. 6 is a flow chart illustrating a paper tension adjusting method according to the present invention.
Figure 6:
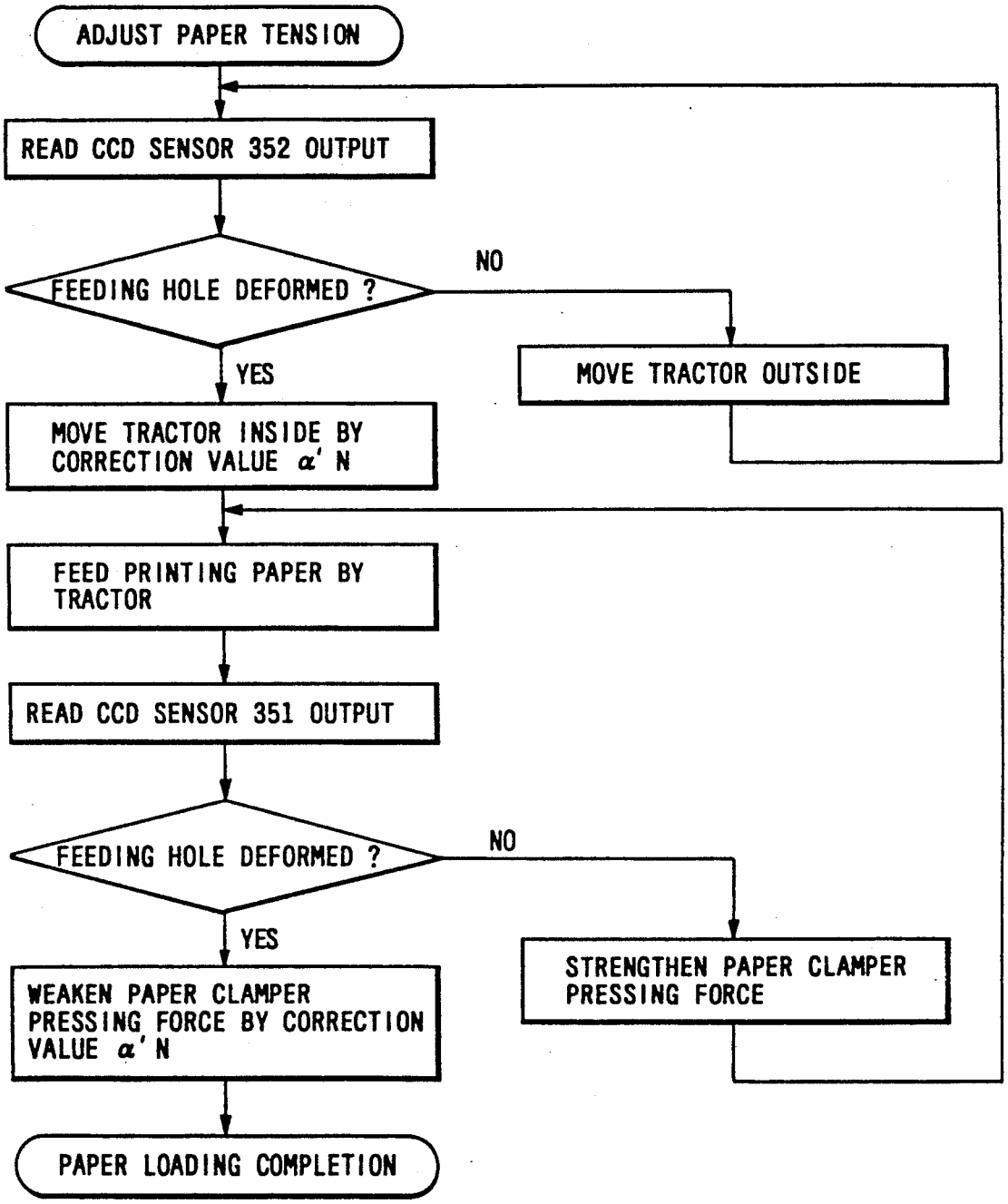

An example of the above-mentioned method of mounting paper will be described with reference to the flow chart in FIG. 6.

The paper 7 is mounted by fitting the feeding apertures thereof into the feeding pins 34. The motor 15 is driven by a command from the operator 48 and the motor controller 49, the distance A between the printing hammers 11 and the printing type 411 is set to a predetermined value, and a variable N is cleared into zero. Under this condition, the printing controller 51 drives the printing hammers 11.

Assuming that the thicknesses of the paper 7 and the ink ribbon 6 are tF and tI respectively, the distance B between the printing hammers 11 and the paper 7 is expressed as B=A-tF-tI. Since the thickness tI of the ink ribbon 6 is substantially fixed, if the paper is thick, the distance B becomes small so that the above-mentioned flight time becomes short. To the contrary, if the paper 7 is thin, the distance B becomes large so that the above-mentioned flight time becomes long. Therefore the motor 15 is driven so as to adjust the flight time to be a fixed, predetermined value, and the quantity of this adjustment is stored into the variable N. Consequently, the distance B is adjusted to be optimum, and thus the variable N indicates the thickness of the paper 7.

The value of the variable N is put into the operator 48 in which the optimum tension of the paper 7 is calculated. In order to obtain generally superior printing quality and prevent paper jam, the optimum tension T0 is the tension immediately before the feeding apertures are deformed. If the paper 7 is so thick that the feeding apertures are not subject to deformation however, it is preferable to mount the paper 7 with a slightly weaker tension than the tension T0 so as to reduce the abrasion of the feeding pins 34 or the paper clampers 18. That is, $$T = T0 - atF = T0 - a'N$$

Here, T represents an optimum value of tension, a and a' represent coefficients of paper thickness, and tF represents a paper thickness.

To optimize the widthwise tension of the paper 7, first the right tractor 31R is moved outward in the direction of width of the paper 7 until the feeding apertures are deformed, and next the right tractor 31R is moved inward by a correction value atF.

In order to optimize the tension of the paper 7 in the paper feeding direction, first the pressing force of the paper clamper 18 is increased gradually by the motor 21 while the tractor belt 33 is rotated forward by the motor 39, and next if the feeding apertures are deformed, the pressing force is weakened by the correction value atF. Consequently, it is possible to automatically adjust the distance B between the printing hammers 11 and the paper 7, and the respective tensions of the paper in the direction of width of the paper and in the paper feeding direction into their optimum values.

The foregoing may be summarized as follow.

1. The right tractor 31R is moved outward in the direction of paper width until the feeding apertures are deformed.

2. The right tractor 31R is moved back inward by the correction value atF.

3. While the tractor belt 33 is rotated by the motor 39, the pressing force of the paper clampers 18 is increased gradually by the motor 21.

4. If the feeding apertures are deformed, the pressing force of the paper clampers 18 is weakened by the correction value atF, so as to weaken the tension.

By the above adjustment, the respective tensions of the paper 7 in the paper width direction and in the paper feeding direction are adjusted to their optimum values.

Although two CCD sensors are used in the above-mentioned embodiment, a single two-directional CCD sensor capable of reading plane information may be provided in one of tractors. Moreover, although the right tractor is moved back and a pressing force of paper clampers is weakened after the above-mentioned feeding apertures are deformed, it is possible alternatively to detect the position of the right tractor at the time of mounting paper and move, the right tractor from the detected position in accordance with the thickness of the paper to thereby adjust the widthwise tension of the paper, and at the same time, set the pressing force of the paper clampers to its initial value at the time of mounting the paper, and then adjust the pressing force of the paper clampers in accordance with the thickness of the paper.

According to the present invention, since the respective tensions of paper to be used in the paper width direction and in the paper feeding direction can be automatically adjusted to their optimum values in accordance with the thickness and rigidity of the paper, it is not only possible to easily mount various paper, but also possible to prevent problems such as paper jam, defective printing, etc., due to erroneous paper mounting.

What is claimed is:

1. A paper tension adjusting device for a continuous paper printing printer in which paper having thickness and rigidity and which is under tension in at least the widthwise direction is fed by at least one pair of tractors having feeding pins engagable with feeding apertures formed at the predetermined pitch in the paper along both longitudinal sides thereof and printed thereon comprising:

means for moving at least one of said tractors along the widthwise direction of said paper;

means for determining the desired widthwise tension of said, said determining means further including means for detecting the thickness of said paper; and control means for causing said moving means to move said one tractor in response to said determining means so as to adjust the tension of said paper in the widthwise direction of said paper.

2. A paper tension adjusting devise as in claim 1 wherein said device is an impact printer having printing hammers and said detecting means includes means for detecting the impact of the printing hammers onto the paper.

3. A paper tension adjusting device as in claim 2 wherein said impact detecting means further includes a counter adapted to receive and count clock pulses, control means enabling said counter to count said clock pulses when a hammer is provided with a printing command, and means for producing a signal disabling said counter from further counting in response thereto when said hammer impacts on said paper.

4. A paper tension adjusting device as in claim 3 wherein said moving means includes a motor for moving said one tractor and driver means for controlling said motor to cause movement of said tractor for a distance in accordance with the counts counted by said counter.

5. A paper tension adjusting device as in claim 1 further including a paper clamper separated lengthwise from said tractors for applying tension to said paper in a lengthwise direction and means for adjusting said clamper to adjust the tension of said paper in a lengthwise direction.

6. A paper tension adjusting device as in claim 5 wherein said determining means includes means for detecting the thickness of said paper and determining the desired tension in both the lengthwise and width directions and wherein said control means includes means for controlling said clamper to adjust the tension of said paper in the lengthwise direction.

7. A paper tension adjusting device as in claim 6 further including means for detecting and determining the present tension in both the lengthwise and width directions and wherein said control means causes said moving means to move in accordance with both the present and desired tensions in the width direction.

8. A paper tension adjusting device as in claim 7 wherein said tension detecting means includes an optical sensor for detecting the position of a feeding pin with respect to the feeding apertures pin which said in is engaged.

9. A printer comprising:

means for printing onto a paper having thickness and rigidity and which is under tension in both the widthwise and lengthwise direction;

means for feeding the paper past said printing means including a pair of tractors having feeding pins engagable with feeding apertures formed at the predetermined pitch in the paper along both longitudinal sides thereof;

means for moving at least one of said tractors along the widthwise direction of said paper;

a paper clamper separated lengthwise from said tractors for applying the tension to said paper in said lengthwise direction and means for adjusting said clamper to adjust the tension of said paper in said lengthwise direction;

means for determining the desired widthwise and lengthwise tensions of said paper;

control means for causing said moving means to move said one tractor in response to said determining means so as to adjust the tension of said paper in the direction of width of said paper, said control means further including means for controlling said clamper to adjust the tension of said paper in the lengthwise direction;

means for detecting and determining the present tension in both the lengthwise and width directions and wherein said control means cause said moving means to move in accordance with both said present and desired tensions in both the lengthwise and width directions; and wherein said tension detecting means includes an optical sensor for detecting the position of a feeding pin with respect to the feeding aperture in which said pin is engaged.

10. A printer as in claim 9 wherein said printing means includes a plurality of printing hammers.

11. A printer as in claim 10 wherein said determining means includes means for detecting the thickness of said paper.

12. A printer as in claim 11 wherein said detecting means includes means for detecting the impact of the printing hammers onto the paper.

13. A printer as in claim 12 wherein said impact detecting means further includes a counter adapted to receive and count clock pulses, control means enabling said counter to count said clock pulses when a hammer is provided with a printing command, and means for producing a signal disabling said counter from further counting in response thereto wherein said hammer impacts on said paper.

14. A printer as in claim 13 wherein said moving means includes a motor for moving said one tractor and driver means for controlling said motor to cause movement of said tractor for a distance in accordance with the counts counted by said counter.

15. A method of adjusting tension in a continuous paper printing printer having a pair of tractors with feeding pins engagable with feeding apertures formed at a predetermined pitch in the paper along both longitudinal sides thereof for advancing the paper during printing comprising the steps of:

(a) determining the desired tension in at least the widthwise direction; and (b) moving at least one of said tractors along the widthwise direction in accordance with the desired tension;

wherein said step of widthwise determining includes optically detecting the relative position of at least one feeding pin and the aperture in which that feeding pin is engaged.

16. A method as in claim 15 further including determining the desired tension in the lengthwise direction, clamping the paper at a location separated from said tractors to produce lengthwise tension, and adjusting the clamping in accordance with the desired lengthwise tension.

17. A method as in claim 15 further including detecting the paper thickness.

18. A method as in claim 15 including clamping said paper at a location separated from said tractors to impact lengthwise tension to said paper, determining the lengthwise tension by optically detecting the relative positions of at least one feeding pin and the aperture which that feeding pin engages, determining the desired lengthwise tension, and adjusting the lengthwise tension.

19. A paper tension adjusting device for a continuous paper printing printer in which paper having thickness and rigidity and which is under tension in both widthwise and lengthwise directions is fed by at least one pair of tractors having feeding pins engagable with feeding apertures formed at a predetermined pitch in said paper along both longitudinal sides thereof and printed thereon comprising:

means for moving at least one of said tractors in said widthwise direction;

a paper clamper separated lengthwise from said tractors for applying said tension in said lengthwise direction; and means for adjusting said clamper to adjust the tension of said paper in said lengthwise direction;

means for determining the desired tension of the paper in both of said directions;

control means for causing said moving means to move said one tractor in response to said determining means so as to adjust the tension of said in said widthwise direction;

said determining means further including means for detecting the thickness of said paper and determining the desired tension in both of said directions and said control means including means for controlling said clamper to adjust the tension said paper in said lengthwise direction;

said device further including means for detecting and determining the present tension in both of said directions and wherein said control means causes said moving means to move in accordance with both the present and desired tension in said widthwise direction, and wherein said tension detecting means includes an optical sensor for detecting the position of a feeding pin with respect to the feeding apertures in which said pin is engaged.

* * * * *